US005088712A

United States Patent [19]

Luperti

[11] Patent Number: 5,088,712

[45] Date of Patent: Feb. 18, 1992

[54] SHEET SET SEPARATION USING WIDE FOLDED STRIPS

[75] Inventor: Harry E. Luperti, Bethel, Conn.

[73] Assignee: Pitney Bowes Inc., Stamford, Conn.

[21] Appl. No.: 636,342

[22] Filed: Dec. 31, 1990

[51] Int. Cl.[5] ..... B65H 33/04

[52] U.S. Cl. ..... 270/95; 414/789.5

[58] Field of Search ..... 270/58, 59, 95, 32, 270/45; 414/789.5, 790.8; 271/215, 217, 218

[56] References Cited

U.S. PATENT DOCUMENTS

| | | | |
|---|---|---|---|
| Re. 23,641 | 4/1953 | Andren | 414/789.5 |
| 2,052,615 | 9/1936 | Foellmer . | |
| 2,621,737 | 12/1952 | Ledig . | |
| 2,795,172 | 6/1957 | Hanson . | |
| 2,837,016 | 6/1958 | Jezierski . | |
| 3,128,219 | 4/1964 | Cummings . | |
| 3,205,739 | 9/1965 | Meyer-Jagenberg | 270/95 |
| 3,458,186 | 7/1969 | Schmidt . | |
| 3,466,983 | 9/1969 | Meyer-Jagenberg | 270/95 |
| 3,860,127 | 1/1975 | Fassman . | |
| 3,902,646 | 9/1975 | Kuhns . | |
| 3,911,517 | 10/1975 | Davis . | |
| 4,017,066 | 4/1977 | Lasher et al. . | |
| 4,586,232 | 5/1986 | Ohmura et al. . | |
| 4,611,736 | 9/1986 | Gavronsky et al. . | |

FOREIGN PATENT DOCUMENTS

| | | | |
|---|---|---|---|
| 27861 | 2/1982 | Japan | 270/95 |

*Primary Examiner*—Edward K. Look
*Assistant Examiner*—Therese M. Newholm
*Attorney, Agent, or Firm*—Charles R. Malandra, Jr.; David E. Pitchenik; Melvin J. Scolnick

[57] ABSTRACT

Apparatus and a method are disclosed for associating a relatively wide strip with a set of stacked sheets. The strip, which may be a paper tape, is positioned to intersect a path along which a set of sheets such as paper sheets is advanced. The sheet set is advanced towards the strip and a nip is formed by a pair of opposed belt conveyers so that the downstream edge of the sheet set engages the strip and carries the strip into the nip of the belt conveyers where the strip is folded at least once to the sheet set adjacent the downstream edge of the sheet set. The strip is indexed from a roll to the position in the path of the sheet set. The strip is tensioned and is drawn against a knife edge as the sheet set advanced through the nip to sever the strip from the roll. Pairs of opposed rollers, each pair forming another nip, are disposed adjacent the nip formed by the belt conveyers to cooperate with that nip and form a wider composite nip for folding wider strips and skewed narrower strips.

14 Claims, 5 Drawing Sheets

GEARING
MOTOR

SHEET SET SEPARATION USING WIDE FOLDED STRIPS

BACKGROUND OF THE INVENTION

The invention disclosed herein relates to separating sets of sheet material, for example, sets of paper sheets in paper processing apparatus such as copiers and mailing machines. More particularly, the invention relates to associating strips of material with sets of sheet material to separate the sets.

One technique for separating sets of one or more stacked sheets is to offset the sheet sets. See, for example, U.S. Pat. Nos. 3,860,127 (Fassman) and 4,017,066 (Lasher et al.). One drawback of this sheet set separation technique is that the offset is easily lost and that the once-separated sheet sets are easily mingled.

Another technique positions one or more strips of paper between the adjacent sheet sets to be separated. According to this technique, a strip loosely lies between the first and last sheets of the sets to be separated, i.e., the strip is not adhered or affixed to the sheets in any way and becomes engaged solely by virtue of being between adjacent sheets of adjacent sets. See, for example, U.S. Pat. Nos. 2,052,615 (Foellmer), 2,795,172 (Hanson) 2,837,016 (Jezierski) and 3,458,186 (Schmidt). One drawback of this technique is that the strips easily fall out or the strips are easily moved so they are not easily visible from the exterior of a stack of sheet sets. Typically, this technique involves advancing the strip from a roll thereof, inserting the strip adjacent the first or last sheet of a set, severing the strip from the roll and moving the next sheet from the adjacent set into position adjacent the inserted strip, although not necessarily in the order described.

In the patents cited above in connection with positioning a strip between sets of sheets to be separated, the strip is advanced from a roll thereof and severed therefrom. U.S. Pat. Nos. 2,621,737 (Ledig), 3,128,219 (Cummings), 3,902,646 (Kuhns), 3,911,517 (Davis) and 4,611,736 (Gavronsky et al.) disclose strip or tape dispensing apparatus in which a strip or tape is withdrawn from a roll, severed therefrom and adhered to a sheet. In these four patents, however, the strip is adhered to a sheet of a sheet set, not for separating a sheet set, but for binding the sheets of a set together, or is adhered to a sheet for other reasons. U.S. Pat. No. 4,586,232 (Ohmura et al.) discloses wrapping bundles with shrink wrapping film withdrawn and severed from a roll thereof, in which the film is positioned in the path of an advancing bundle where it is engaged by and drawn around the advancing bundle.

Co-pending U.S. patent application Ser. No. (632,805), titled "SHEET SET SEPARATION USING FOLDED SHEETS", filed 12/24/90, which is assigned to the assignee of this application, discloses apparatus for folding a strip of paper about the edge of a set of stacked sheets of paper to separate that sheet set from other adjacent sheet sets. The disclosure of said application is incorporated herein by reference. As disclosed in the co-pending application, the folded strip of paper has strip portions extending substantial distances along major sides of the sheet set. Such a folded strip separator reduces the risk that the strip will be moved between adjacent sheet sets so as not to be visible from the side of a stack of sheets sets and also reduces the risk that the strip will be separated altogether from the sheet set.

In the folding apparatus disclosed in the co-pending application, as illustrated in FIGS. 1, 2 and 4 in this application, a strip of paper 33 is held in the path of an advancing sheet set 16 which engages the strip and carries it into the folding nip 60 formed by a pair of opposed belt conveyers, which folds the strip 33 about the edge 38 of the sheet set 16 as the sheet set advances into and through nip 60. The width of the folding nip 60 is approximately the width of the belts 65 and 66 formed by the upper and lower belt conveyers, respectively. While the quality of the fold made by such apparatus of paper strips having a width not substantially wider than the width of the belts was found to be entirely satisfactorily, it was found also that the quality of the fold of paper strips having widths substantially wider than the width of the belts was not entirely satisfactory. It was also found that the quality of the fold of a strip having approximately the width of the belts which was fed to the folding nip skewed was also not entirely satisfactory. The invention disclosed in this application addresses those drawbacks.

SUMMARY OF THE INVENTION

It is an object of the invention disclosed herein to improve apparatus of the type in which a strip of material is folded about the edge of a set of stacked sheets to separate the set from other adjacent sheet sets.

It is another object of the invention to improve the apparatus disclosed in the co-pending application.

It is another object of the invention to permit such apparatus to utilize wider strips without reducing the quality of the folds of the strips.

The above and other objects of the invention are achieved by retaining the belt conveyers of apparatus of the type disclosed in the co-pending application and providing folding means for folding in cooperation with the nip of the belt conveyers a strip that is wider than the width of the belt conveyors. In a specific embodiment, the folding means comprises means forming another nip adjacent the nip of the belt conveyers, which another nip is positioned with respect to the nip of the belt conveyers to form a composite nip through which the strip is advanced.

The composite nip in accordance with the invention comprises a first folding nip formed by the pair of opposed belt conveyers and a second folding nip formed adjacent the first folding nip by a pair of opposed rolling means, e.g., opposed rollers. The composite folding nip is thereby made wider than the first folding nip. Preferably, a third folding nip is formed by another pair of opposed rolling means adjacent the side of the first folding nip opposite the side on which the second folding nip is formed. The first, second and third folding nips then form the composite folding nip. Preferably, either or both pairs of the rolling means forming the second and third folding nips are formed by two opposed rollers, although other means such as a belt conveyer may also be used as a rolling means.

As disclosed briefly above and in detail in the co-pending application, the opposed belt conveyers comprise an upper belt conveyer and a lower belt conveyer which form a folding nip. Each of the upper and lower belt conveyers is supported and driven by a pulley system. The folding nip itself is formed by the outer surface of the upper belt as supported by an upper pulley and the outer surface of the lower belt as supported by a lower roller, although other arrangements of a belt or belts, or another moving or stationary surface, a pulley or pulleys and/or a roller or rollers, etc., may be used. According to the preferred embodiment of the invention, for improved folding of wider strips and skewed strips, an upper roller is disposed adjacent one side of the upper pulley and another lower roller is disposed opposite and below the second roller adjacent one side of the lower roller of the lower belt conveyer. Where those two additional rollers are disposed on only one side of the upper pulley and lower belt conveyer roller, the strip to be folded is positioned centered relative to the composite nip formed by the two additional rollers and the upper and lower belt conveyers, which position is offset with respect to the upper and lower belts. Therefore, it is preferable to provide in accordance with the invention still another upper roller disposed adjacent the other side of the upper pulley, and still another lower roller disposed opposite and below that other upper roller adjacent the other side of the belt conveyer lower roller. This arrangement provides a composite nip formed by one pair of opposed rollers, the belt conveyers and the other pair of opposed rollers.

BRIEF DESCRIPTION OF THE DRAWINGS

The invention is illustrated by way of example and not limitation in the figures of the accompanying drawings in which like references denote like or corresponding parts, and in which.

DESCRIPTION OF THE PREFERRED EMBODIMENTS

Figure 1:
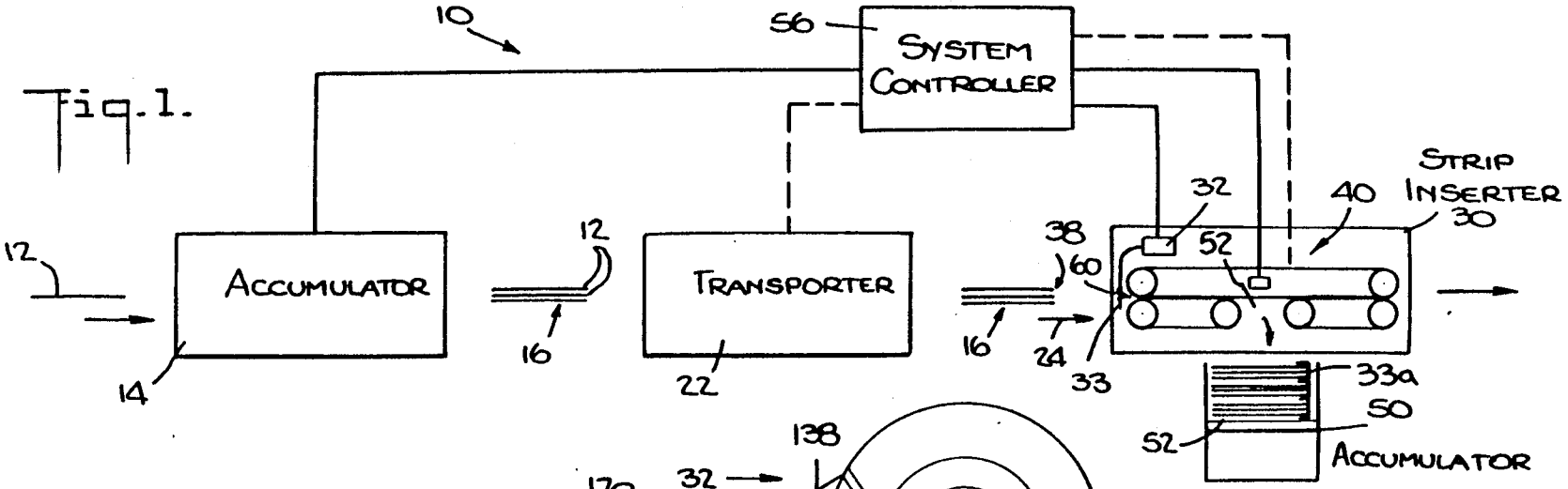
FIG. 1 is a block diagram of a paper processing system incorporating strip inserting apparatus for sheet set separation.

Referring to FIG. 1, a paper processing system 10 transports sheets 12 of paper from, for example, a photocopying station (not shown) towards an accumulator 14 where they are stacked into sheet sets 16. The number of sheets 12 to be accumulated in each sheet set 16 may vary, and may be determined conventionally. After exiting accumulator 14, the sheet sets 16 are advanced by a transporter 22 along a path 24 towards and into a strip inserter 30 according to the invention. Strip inserter 30 includes a strip advancer 32 which advances a strip 33 of paper (sometimes referred to as tape) from a roll 34 (FIG. 2) thereof into the path 24 of an advancing set 16, folds the strip around the downstream edge 38 of the sheet set 16 and severs the folded strip **33*a* from the roll 34**.

Strip inserter 30 includes a diverter 52 which either diverts sheet sets 16 with folded strips **33*a* applied thereto into stack accumulator 50, or allows sheet sets of one or more sheets 12 without a folded strip 33*a* to advance to a downstream transporter or an accumulator (not shown). Accumulator 50 has a platform 52 which is indexed downwardly each time it receives a sheet set 16 to thereby accommodate a number of stacked sheet sets 16. System 10 includes a system controller 56 which controls sheet accumulation in accumulator 14, advancing of strip material 33 by strip advancer 32 and the positioning of diverter 52 in strip inserter 32. Transporter 22 and strip folder 40 which continues the advance of a sheet set 16 therethrough, may run continuously, i.e., whenever system 10 is active, or intermittently under control of system controller 56. System controller 56, accumulator 14 and transporter 22** may be conventional.

Figure 2:
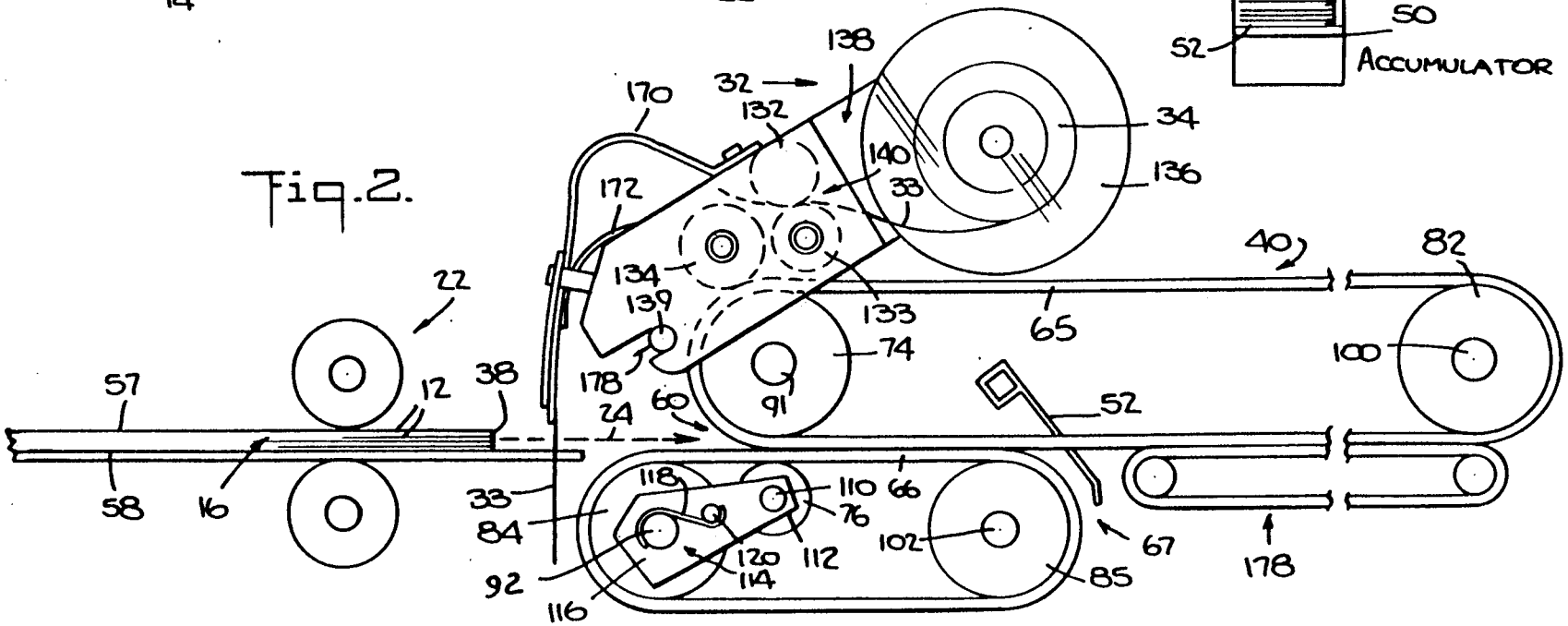
FIG. 2 is a generally schematic side view of the strip inserting apparatus according to the invention showing the strip positioned in the path of and about to be engaged by an advancing set of stacked sheets.
Figure 4:
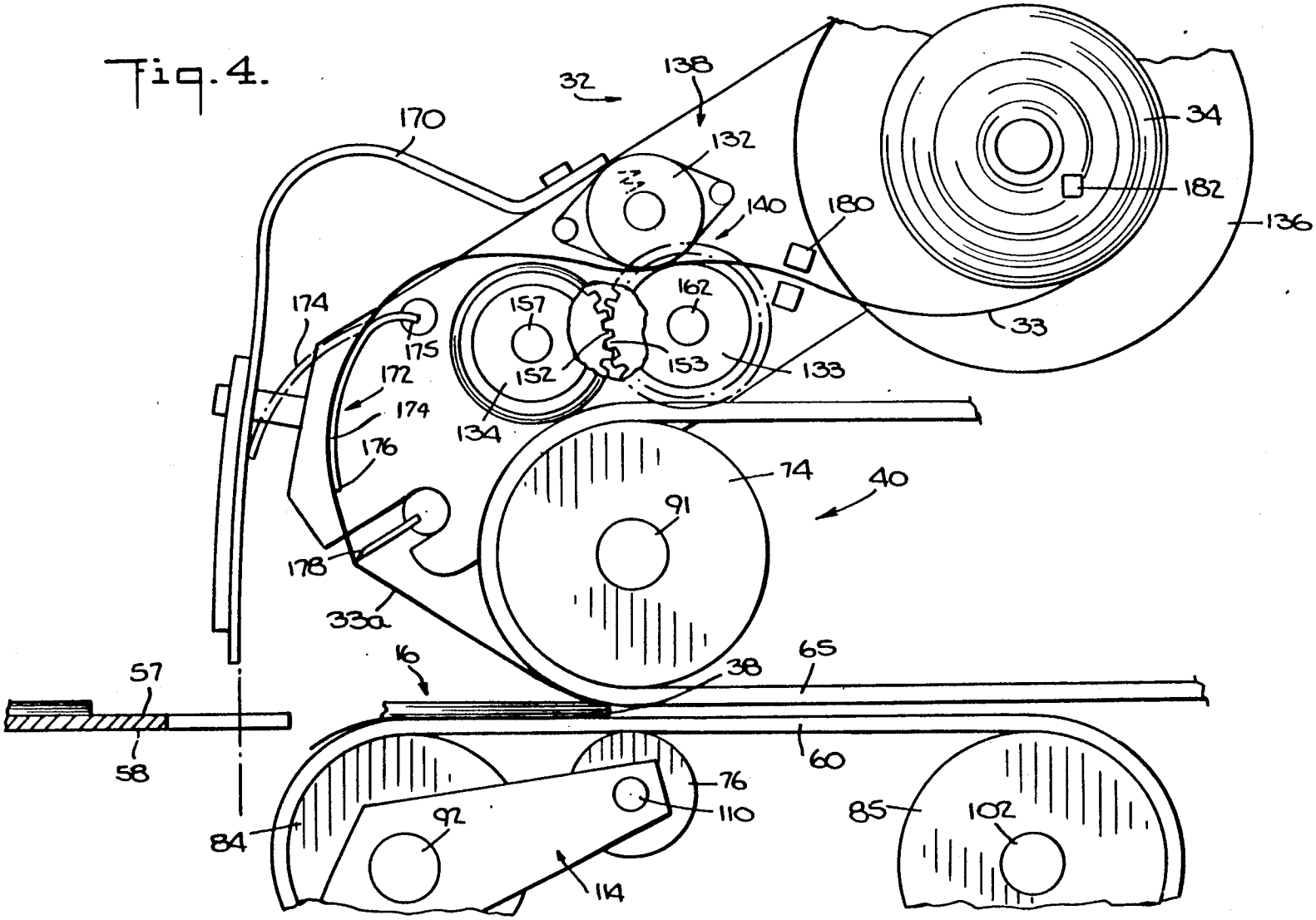
FIG. 4 is a side sectional view of a portion of the strip inserting apparatus of FIG. 3 showing the strip material engaged by the downstream edge of the advancing sheet set and being drawn against a knife edge.

FIGS. 2 and 4 illustrate a sequence in which a sheet set 16 is advanced along path 24 towards a strip 33 positioned intersecting path 24 (FIG. 2), and in which the downstream edge 38 of advancing sheet stack 16 engages strip 33 and carries it to a strip folder 40 in strip inserter 30 which folds the strip 33 into the strip **33*a* (FIG. 4). A folding nip formed at 60 in strip folder 40 receives the downstream edge 38 of sheet set 16 and a strip 33 engaged by the advancing sheet set edge 38, and folds the strip 33 around the sheet set edge 38 as the set is advanced along path 24 into strip folder 40. The strip 33 is folded so that substantial portions extend along and parallel to opposed major sides 57, 58 of sheet set 16**.

Figure 3:
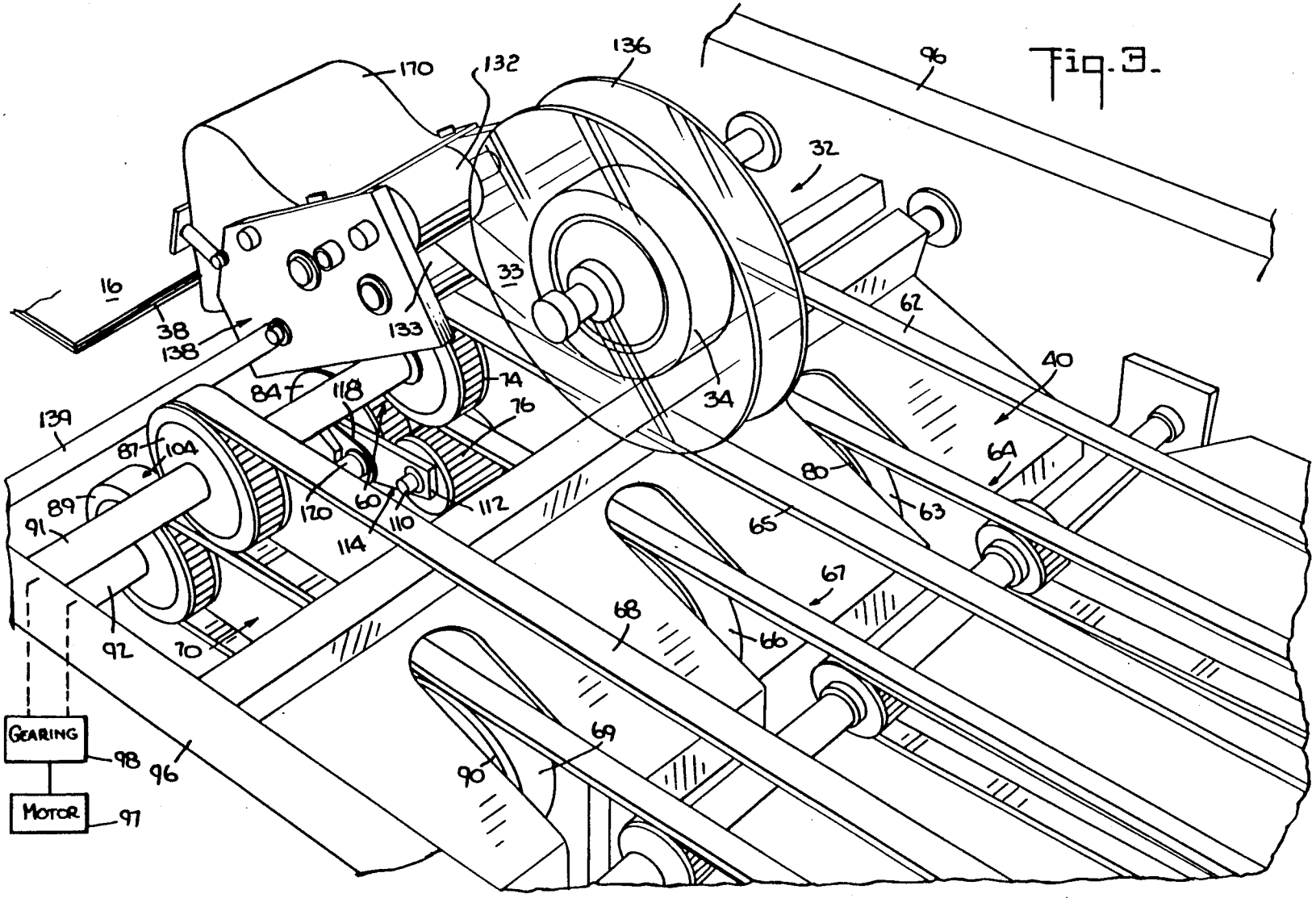
FIG. 3 is a top perspective view of the strip inserting apparatus depicted in FIG. 2.

As shown in FIG. 3, strip folder 40 comprises three laterally-spaced pairs of upper and lower endless belts, 64, 67 and 70. Upper belt 62 and lower belt 63 form an outer pair 64; upper belt 65 and lower belt 66 form an intermediate pair 67; and upper belt 68 and lower belt 69 form another outer pair 70. The upper and lower belts of each pair are supported generally superposed and aligned with the runs thereof directly opposite and closely adjacent each other. The upper belts of the belt pairs are aligned and the lower belts of the belt pairs are aligned such that the three pairs of belts 64, 67, 70 define a common run for sheets 12 or sheet sets 16 which lies in a common plane between the upper and lower belts. The upper and lower belts of the respective pairs cooperate to engage and advance a paper sheet 12 or a sheet set 16 through the strip folder 40. As described in greater detail below, belts 65 and 66 of the intermediate pair (FIG. 3) form the folding nip 60 and in cooperation with pulley 74 and pulley 76 fold the strip 33 around the downstream edge 38 of sheet set 16 as the sheet set is advanced through the strip folder 40.

Upper outer belt 62 is supported by upstream and downstream upper pulleys which are not visible in the drawings; lower outer belt 63 is supported by upstream and downstream lower pulleys, only the lower downstream pulley 80 of which is visible in the drawings (FIG. 3); intermediate upper belt 65 is supported by upstream and downstream upper pulleys 74 and 82 (FIG. 2), respectively; lower intermediate belt 66 is supported by upstream and downstream lower pulleys 84 and 85, respectively; outer upper belt 68 is supported by upstream and downstream upper pulleys, only the upper upstream pulley 87 of which is visible in the drawings (FIG. 3); and outer lower belt 69 is supported by upstream and downstream lower pulleys 89 and 90, respectively. The upper upstream pulleys for belts 62, 65 and 68 are fixed to an upper upstream shaft 91 to rotate therewith, and the lower upstream pulleys for belts 63, 66 and 69 are fixed to a lower upstream shaft 92 to rotate therewith. Upstream shafts 91 and 92 are supported on opposite ends from frame 96 by bearings and are driven from a common motor 97 via gearing 98. Motor 97 may be run continuously or intermittently under control of system controller 56. The upper downstream pulleys for belts 62, 65 and 68 are fixed to upper downstream shaft 100 (FIG. 2) to rotate therewith, and the lower downstream pulleys for belts 63, 66 and 69 are fixed to lower downstream shaft 102 to rotate therewith. Downstream shafts 100 and 102 are supported by bearings from frame 96 but are not driven.

Outer upper upstream pulley 87 is slightly offset to the downstream side of outer lower upstream pulley 89, and the other outer upper upstream pulley (not shown) is slightly offset to the downstream side of the other outer lower upstream pulley (not shown). This offset causes the nip 104 of outer belts 68 and 69 to be formed adjacent a portion of lower belt 68 that is not passing over lower pulley 89. Thus, nip 104 is not rigid as it would be if it was formed by aligned upper and lower pulleys 87 and 89, but is flexible due to the flex in lower belt 69 to provide a variable height opening to the nip 104 to accommodate sheet sets of different heights. A similar variable height nip opening is provided between outer upper and lower belts 62 and 63.

Folding nip 60 to intermediate belts 65 and 66 is similarly offset from lower upstream pulley 84 to a downstream position adjacent pulley 76. Pulley 76 is rotatably supported on a shaft 110 via bearings mounted to the downstream ends 112 of arms 114. The upstream ends 116 (FIG. 2) of arms spaced 114 are pivotably mounted to lower upstream shaft 92. A spring 118 fixed to shaft 92 bears against projection 120 extending from one of the arms 112 to resiliently urge pulley 76 counterclockwise towards upper upstream pulley 74. Spring 118 is selected so that pulley 76 may be pivoted clockwise against the action of spring 118 as sheet sets of different heights enter nip 60 to provide a variable height nip opening. Spring 118 is also selected so that it urges pulley 76 against upper belt 65 and upper pulley 74 with sufficient force to fold a strip 33 around the downstream edge 38 of a sheet set 16 which is advanced into nip 60 (FIG. 4). Belts 65 and 66 sandwich a cut strip 33*a* and a sheet set 16 therebetween and maintain strip 33*a* against the major sides of the sheet set as the sheet set is advanced towards accumulator 50.

Thus, the belts and pulleys of strip folder 40 cooperate to advance a sheet set 16 through the strip folder 40 while pulley 76 and belt 66 cooperate with pulley 74 and belt 65 to fold a strip 33 around the upstream edge 38 of a sheet set advanced into nip 60.

Referring to FIGS. 2–4, strip inserter 30 includes a strip dispenser 32 comprising rollers 132–134 and a reel 136 for a roll 34 of strip material, all mounted on a frame 138 pivotably mounted to a shaft 139 fixed to frame 96. Frame 138 in its unpivoted position depicted in FIG. 2 rests under its own weight and the moment generated from pivoting about shaft 139 with roller 134 causes engagement with upper intermediate belt 65. The entire strip dispenser 32 including rollers 132–134 and reel 136 may be pivoted away from the strip folder 40. This provides easy access to the strip folder 40 and to the strip dispenser 32 for clearing jams, servicing, inserting new rolls 34 of strip material and repair.

Figure 5:
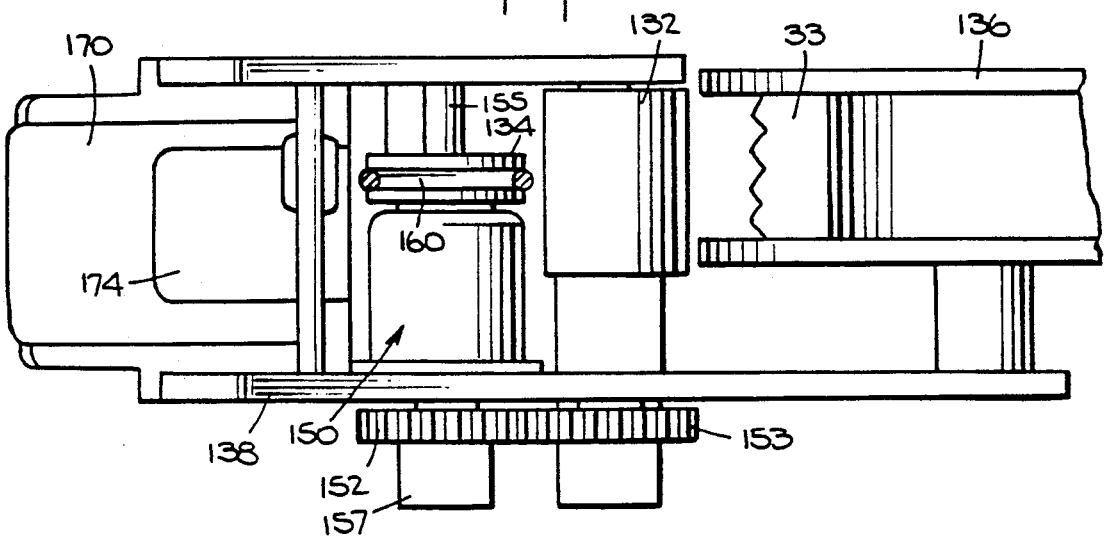
FIG. 5 is a top view of the strip dispensing portion of the strip inserting apparatus of FIG. 2.
Figure 6:
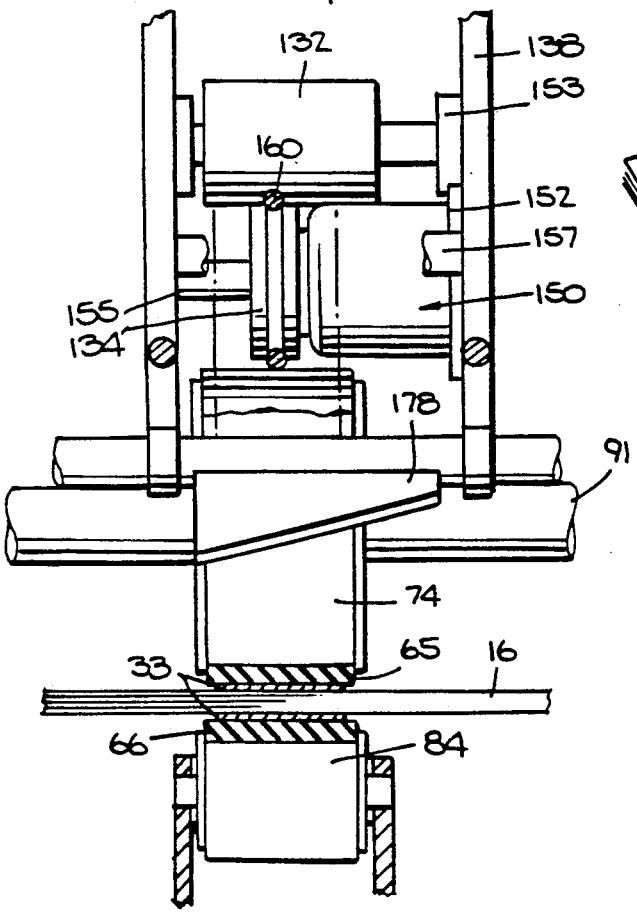
FIG. 6 is a front cross section view of the strip dispensing apparatus depicted in FIG. 5 and the lower portion of the strip inserting apparatus.

Reel 136 is supported from frame 138 to rotate when tension is put on strip material 33 so that strip material may be withdrawn from reel 136. Roller 132 and roller 133 are rotatably supported closely adjacent each other from frame 138 to form a nip 140 through which strip material 32 is fed. Roller 132 is an idler roller, and roller 133 is driven by roller 134, clutch 150 (FIG. 5) and gears 152, 153 as follows to withdraw tape from reel 136. Referring to FIGS. 5 and 6, clutch 150 includes a rotatable input shaft 155 rotatably mounted at its free end to frame 138 by a bearing. Roller 134 is fixed to input shaft 155 supported closely adjacent intermediate upper pulley 74 of strip folder 40. Clutch 150 also includes a rotatable output shaft 157 rotatably mounted to frame 138 by a bearing. Clutch 150 selectively couples rotation of input shaft 155 (FIGS. 5–6) to output shaft 157 upon unclutching of clutch 150 by a control signal from system controller 56 (FIG. 1).

An O-ring 160 is fixed to roller 134 about the circumference thereof to rotate therewith. O-ring 160 is engaged by intermediate upper belt 65 where it passes around upper pulley 74 so that rotation of upper belt 65 causes roller 134 and input shaft 155 to rotate. Gear 152 is fixed to output shaft 157 and gear 153 is fixed to the shaft 162 of roller 133 (see FIG. 4) to rotate therewith in mesh with gear 152. Thus, actuation of clutch 155 rotates gear 152 which rotates gear 153 and roller 133. Since belt 65 may be rotated continuously, driving power for strip advancing roller 133 is available upon demand. When clutch 155 is clutched, i.e., not rotating gear 152, rollers 133 and 134 are stationary and engage and hold strip material 33 therebetween so strip material is not withdrawn from reel 136 and may be tensioned for severing by the advance of sheet stack 16.

Strip material 33 is advanced when clutch 155 is unclutched, i.e., roller 134 is driven, between a rigid, transparent curved outer guide 170 (FIGS. 4 and 5) and a flexible inner guide 172 both attached to frame 138. Each time that clutch 155 is unclutched, it remains unclutched for a sufficient time to index a predetermined length of strip material 33 which is long enough to wrap around the downstream edge 38 of the largest sheet set expected with substantial portions of the strip extending along the major surfaces 57, 58 of the sheet set. Outer guide 170 terminates above and slightly upstream of lower intermediate pulley 76 and turns the strip material 33 from roll 34 90° so it hangs in the path 24 of a sheet set 16 being advanced into strip inserter 30. Inner guide 172 comprises a flexible sheet 174 having an upstream end 175 fixed to frame 138 and a downstream free end 176. Sheet 174 is thin and flexes towards a serrated knife edge 178 also fixed to frame 138. When strip material 33 is hanging in the path 24 of an advancing sheet set, the strip material 33 and the sheet 174 are in the broken line positions illustrated in FIG. 4. Flexible sheet 174 is flexed towards knife edge 178 when strip material 33 is engaged by an advancing sheet set and held between rollers 133 and 134. Flexing continues until the strip material 33 is brought against and cut by knife edge 178, illustrated in FIG. 4 by the solid line positions of strip material 33 and sheet 174. Upon severing strip material 33 from roll 34 thereof, sheet 174 flexes back to the broken line position illustrated in FIG. 4.

Sheet sets 16 with strips 33*a* applied thereto are accumulated in accumulator 50. FIGS. 1–3 show diverter 52 in its lower position to direct sheet sets 16 to accumulator 50. System controller 56 provides a signal to a drive (not shown) for diverter 52 to move it to its upper position which directs sheets to a transporter section of strip inserter 30 defined by the down stream end of belts 62, 63, 65, 66 and 68, 69, and another three pairs of lower belts referenced generally by 178 in FIG. 2. Diverter 52 is located upstream of belts 178.

An out of strip material sensor 180 (FIG. 4) carried by frame 138 between rollers 132, 133 and reel 136 is coupled to system controller 56 to monitor whether sufficient strip material is left for the next folding operation. Strip supply sensor 182 (FIG. 4) carried by frame 138 adjacent reel 136 is coupled to system controller 56 to monitor when a predetermined amount of strip material has been withdrawn from the reel, e.g. $\frac{3}{4}$ of a full reel.

Figure 7:
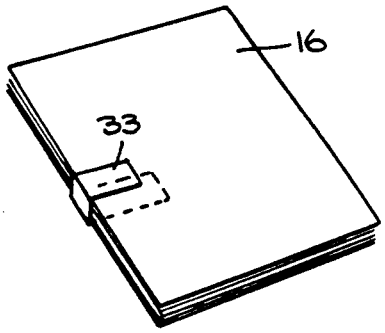
FIG. 7 is a top perspective view of a set of stack sheets to which a single folded strip has been applied in accordance with the invention to separate the set from other sets of stacked sheets.
Figure 8:
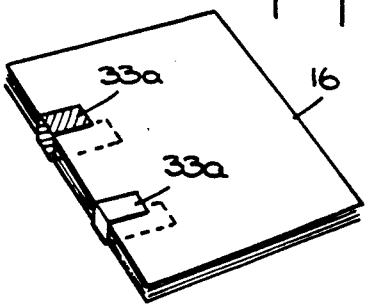
FIG. 8 is a top perspective view of a set of stacked sheets to which a plurality of folded strips has been applied to separate the set from adjacent sets of stacked sheets.

In accordance with the invention one or more strips 33*a* may be applied to sheet sets 16 as shown in FIGS. 7 and 8. The strips may be of any desired color or colors. Where more than one strip 33*a* is to be applied to a sheet set, a strip inserter 30*a* is provided which comprise a pair of folding nips 60 which are the same or similar to nip 60 described above.

Figure 9:
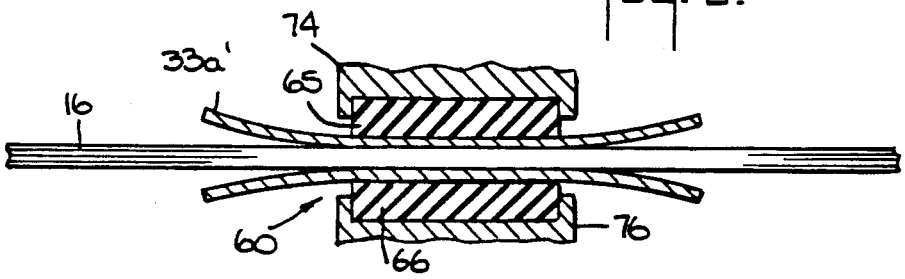
FIG. 9 is a vertical section view taken through the belts, pulley and roller of the strip folding portion of the apparatus of FIG. 2 where they form a folding nip for folding the strip material, showing the apparatus folding strip material substantially wider than the width of the belts.

Strip material 33 preferably has a width close or equal to the width of intermediate upper and lower belts 65 and 66 which improves the folding action on strip material 33. For example, in the illustrated embodiment, the width of strip 33 is up to about $\frac{3}{4}$ inch. However, it may be desirable to use a wider strip than the strip 33 illustrated in FIGS. 2–8, e.g., a standard width calculator tape, which may be $1\frac{1}{8}$ inch or more. In cases where such a wider strip is substantially wider than the width of belts 65 and 66, it was found that folding such a wider strip 33' in the nip 60 of belts 65 and 66 produced a folded strip 33*a'* having bowed edges as depicted in FIG. 9.

Figure 10:
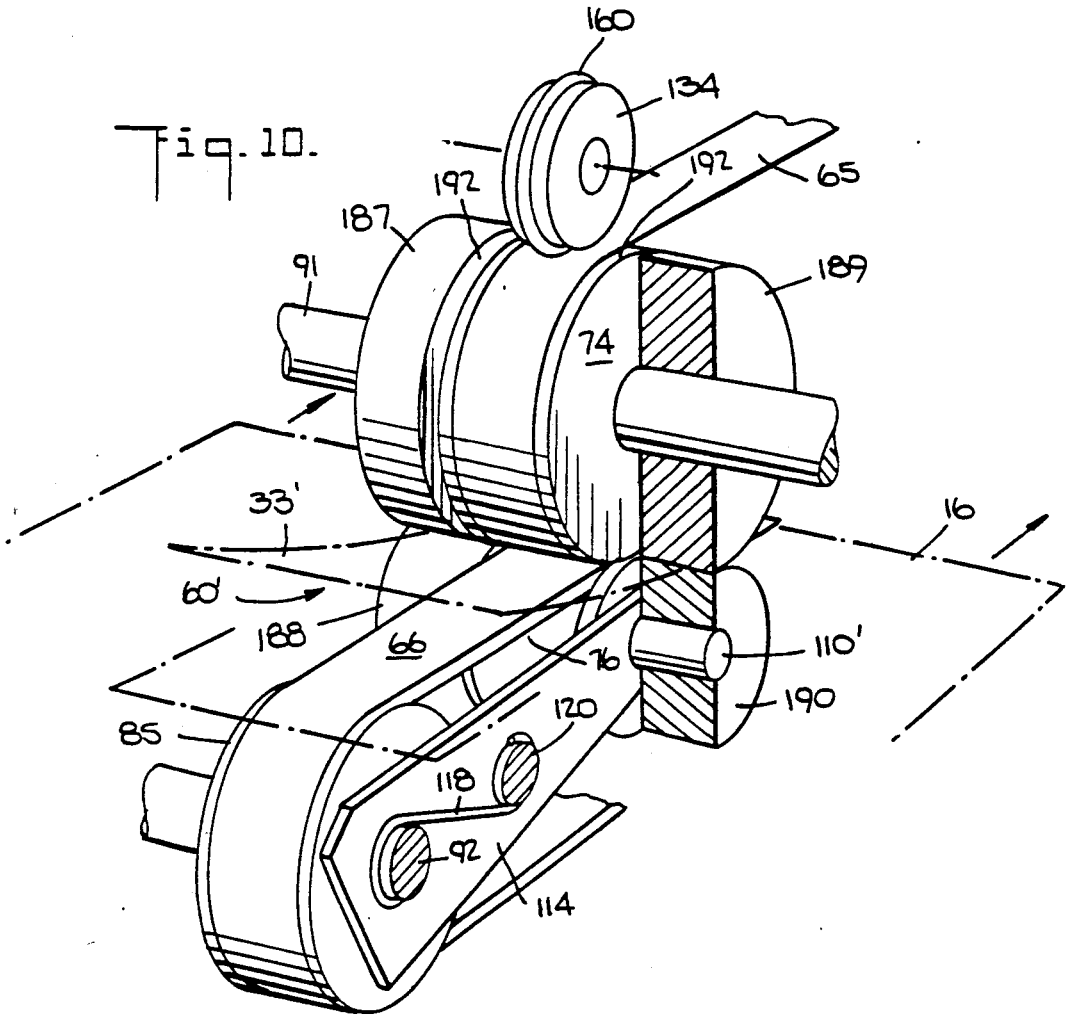
FIG. 10 is a front prospective view, partially in section, of portions of upper and lower belt conveyers and rollers forming a composite nip in accordance with the invention, wider than the nip of the belt conveyers alone, for folding the strip material.
Figure 11:
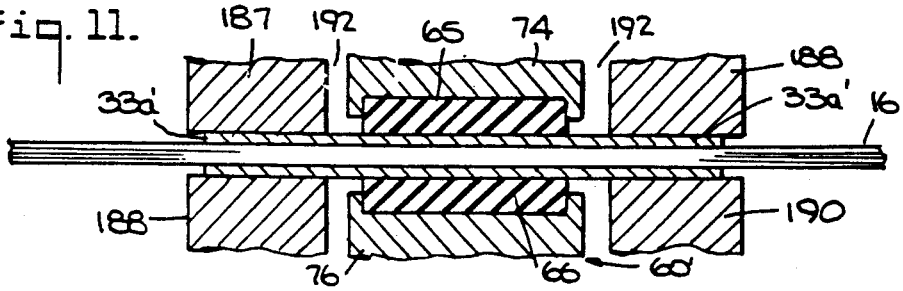
FIG. 11 is vertical section view taken through the belts, rollers and the pulley depicted in FIG. 10 which form the composite nip, showing a sheet set and a folded strip wider than the strip depicted in FIGS. 2–8.

Referring to FIGS. 10 and 11, a wider composite nip 60' is formed in accordance with the invention with additional rollers 187–190. Upper roller 187 is fixed to shaft 91 to rotate therewith adjacent one side of upper intermediate pulley 74; lower roller 188 is fixed to the shaft 110' to rotate therewith adjacent one side of pulley 76 and opposite to upper roller 187; upper roller 189 if fixed to shaft 91 to rotate therewith adjacent the other side of upper intermediate pulley 74; and lower roller 190 is fixed to the shaft 110' to rotate therewith adjacent the other side of pulley 76 and opposite to upper roller 188. The radius of upper rollers 187 and 189 is such that the outer peripheral surfaces of rollers 187 and 189 and the outer surface of upper belt 65 form an upper folding line at nip 60', and the radius of lower rollers 188 and 190 is such that the outer peripheral surfaces of rollers 188 and 190 and the outer surface of lower belt 66 form a lower folding line at nip 60'. Lower rollers 188 and 190 are fixed to shaft 110' outside of arms 114, and upper rollers 187 and 189 are positioned opposite the lower rollers 188 and 190, which provides the small spaces 192 in nip 60' shown in FIGS. 9 and 10; such spaces have little or no effect on the quality of the fold of strip 33'. Roller 134 of the strip advancer 32 continues to be driven by belt 65, as in the embodiment of FIGS. 2–6.

Certain changes and modifications of the embodiments of the invention herein disclosed will be readily apparent to those of skill in the art. It is the applicant's intention to cover by the claims all such uses and all those changes and modifications which could be made to the embodiments of the invention herein chosen for the purposes of disclosure which do not depart from the spirit and scope of the invention.

What is claimed is:

1. Apparatus for applying a strip of material to a set of stacked sheets for separating that set from other sets, comprising:

means for holding a strip of material in a path along which a set of stacked sheets is being advanced;

first and second belt conveyers disposed opposite and aligned with each other to define a run therebetween, said first belt conveyer comprising a first rolling means and a first belt passing adjacent thereto and said second belt conveyer comprising a second rolling means and a second belt passing adjacent thereto, said first and said second rolling means being positioned to form with said first and second belts a nip, said nip defining an entrance to said run, said strip being wider than said nip;

means for driving said belts in synchronism;

means for advancing said sheet set towards said strip and said composite nip, past said strip and into and through said nip such that the downstream edge of said sheet set engages said strip with portions of said strip extending beyond first and second opposed major sides of said sheet set and advances into said nip; and means disposed adjacent said first and second rolling means for folding a portion of said strip not passing into said nip;

whereby said strip is folded about said downstream edge of said sheet set portions of said folded strip extending generally parallel to and adjacent said major sides as said sheet set.

2. The apparatus of claim 1 wherein said folding means comprises means forming another nip adjacent said nip, said another nip being positioned with respect to said nip to form a composite nip through which said strip is advanced.

3. Apparatus for applying a strip of material to a set of stacked sheets for separating that set from other sets, comprising:

means for holding a strip of material in a path along which a set of stacked sheets is being advanced;

first and second belt conveyers disposed opposite and aligned with each other to define a run therebetween, said first belt conveyer comprising a first rolling means and a first belt passing adjacent thereto and said second belt conveyer comprising a second rolling means and a second belt passing adjacent thereto, said first and second rolling means being positioned to form with said first and second belts a nip, said nip defining an entrance to said run;

means for driving said belts in synchronism;

an additional first rolling means disposed adjacent said first rolling means, said first belt not passing adjacent said additional first rolling means;

an additional second rolling means disposed adjacent said second rolling means aligned with and opposite said additional first rolling means, said second belt not passing adjacent said additional second rolling means;

said additional first and second rolling means cooperating with said nip to form a composite nip wider than said nip; and means for advancing said sheet set towards said strip and said composite nip, past said strip and into and through said composite nip such that the downstream edge of said sheet set engages said strip with portions of said strip extending beyond first and second opposed major sides of said sheet set and advances into said composite nip, whereby said strip is folded about said downstream edge of said sheet set portions of said folded strip extending generally parallel to and adjacent said major sides as said sheet set.

4. The apparatus of claim 3 wherein said additional first and second rolling means are coupled to said driving means for driving said additional first and second rolling means in synchronism with said first and second belts.

5. The apparatus of claim 4 wherein said additional first and second rolling means each comprise a roller disposed adjacent a respective rolling means of a respective belt conveyer.

6. The apparatus of claim 5 wherein said first rolling means of said first belt conveyer comprises a first pulley about which said first belt passes, and said second rolling means of said second belt conveyer comprises an idler roller in generally tangential contact with which said second belt passes, a second pulley disposed adjacent said idler roller around which said second belt passes, said first belt where it passes around said first pulley and said second belt where it passes in tangential contact with said idler roller forming said nip.

7. The apparatus of claim 6 wherein said first pulley is supported on a first shaft and said roller of said first additional rolling means is supported on said first shaft adjacent said first pulley, wherein said idler roller is supported on a second shaft, and wherein said roller of said second additional rolling means is also supported on said second shaft, said apparatus comprising means for resiliently supporting said idler roller and said roller of said second additional rolling means for movement towards and away from said first pulley and said roller of said first additional rolling means such that said second belt and said roller of said second additional rolling means are resiliently held against said first belt and said roller of said first additional rolling means but may be moved away therefrom, whereby said composite nip has a variable size opening thereto.

8. The apparatus of claim 3 comprising a roll of said strip material, means for advancing strip material from said roll into said path with a free end of said strip beyond said first major side and a substantial portion of said strip beyond said second major side, and means for severing said substantial portion of said strip from said roll after said strip has been engaged by said stack downstream edge.

9. Apparatus for applying a strip of material to a set of stacked sheets for separating that set from other sets, comprising:

means for holding a strip of material in a path along which a set of stacked sheets is being advanced;

first and second belt conveyers disposed opposite and aligned with each other to define a run therebetween, said first belt conveyer comprising a first pulley, a first shaft supporting said first pulley and a first belt passing around said first pulley, said second belt conveyer comprising a second pulley and a second belt passing around said second pulley, a first roller disposed adjacent said second pulley and a second shaft supporting said first roller, said second belt passing in tangential contact with said first roller, said first pulley and said first roller being positioned to form with said first and second belts a nip, said nip defining an entrance to said run;

means for driving said belts in synchronism;

a third roller mounted to said first shaft adjacent said first pulley, said first belt not passing around said third roller;

a fourth roller mounted to said second shaft adjacent said first roller and opposite said third roller, said second belt not passing in contact with said fourth roller;

third and fourth rollers cooperating with said nip to form a composite nip wider than said nip; and means for advancing said sheet set towards said strip and said composite nip, past said strip and into and through said composite nip such that the downstream edge of said sheet set engages said strip with portions of said strip extending beyond first and second opposed major sides of said sheet set and advances into said composite nip, whereby said strip is folded about said downstream edge of said sheet set portions of said folded strip extending generally parallel to and adjacent said major sides of said sheet set.

10. The apparatus of claim 9 comprising:

a fifth roller mounted to said first shaft adjacent said first pulley on a side thereof opposite a side on which said third roller is mounted, said first belt not passing around said fifth roller;

a sixth roller mounted to said second shaft adjacent said first roller and opposite said fifth roller on a side of said first roller opposite to a side on which said third roller is mounted, said second belt not passing in contact with said sixth roller;

said fifth and sixth rollers cooperating with said composite nip to form another composite nip wider than said composite nip.

11. The apparatus of claim 10 wherein said driving means drives said first shaft and said second pulley.

12. The apparatus of claim 9 comprising means for resiliently supporting said second shaft for movement towards and away from said first shaft such that said second belt and said third roller are resiliently held against said first belt and said second roller, respectively, but may be moved away therefrom, whereby said composite nip has a variable size opening thereto.

13. The apparatus of claim 10 comprising means for resiliently supporting said second shaft for movement towards and away from said first shaft such that said second belt, said third roller and said fifth roller are resiliently held against said first belt, said second roller, and said sixth roller, respectively, but may be moved away therefrom, whereby said another composite nip has a variable size opening thereto.

14. The apparatus of claim 9 comprising a roll of said strip material, means for advancing strip material from said roll into said path with a free end of said strip beyond said first major side and a substantial portion of said strip beyond said second major side, and means for severing said substantial portion of said strip from said roll after said strip has been engaged by said stack downstream edge.

* * * * *